US009586779B2

(12) United States Patent
Lupi et al.

(10) Patent No.: US 9,586,779 B2
(45) Date of Patent: Mar. 7, 2017

(54) REWINDING MACHINE

(71) Applicant: UNITED CONVERTING S.R.L., Coreglia Antelminelli-Lucca (IT)

(72) Inventors: Giuseppe Lupi, Gallicano-Lucca (IT); Angelo Torri, Gallicano-Lucca (IT); Gianluca Giometti, Loc. Parezzana-Lucca (IT)

(73) Assignee: UNITED CONVERTING S.R.L., Piano di Coreglia-Coreglia Antelminelli-Lucca (IT)

( * ) Notice: Subject to any disclaimer, the term of this patent is extended or adjusted under 35 U.S.C. 154(b) by 182 days.

(21) Appl. No.: 14/406,319

(22) PCT Filed: Jul. 8, 2013

(86) PCT No.: PCT/IT2013/000190
§ 371 (c)(1),
(2) Date: Dec. 8, 2014

(87) PCT Pub. No.: WO2014/009986
PCT Pub. Date: Jan. 16, 2014

(65) Prior Publication Data

US 2015/0129708 A1 May 14, 2015

(30) Foreign Application Priority Data

Jul. 11, 2012 (IT) ..... FI2012A0142

(51) Int. Cl.
*B65H 19/28* (2006.01)
*B65H 19/22* (2006.01)
*B65H 19/26* (2006.01)

(52) U.S. Cl.
CPC ..... *B65H 19/2269* (2013.01); *B65H 19/267* (2013.01); *B65H 19/28* (2013.01); *B65H 2406/12* (2013.01)

(58) Field of Classification Search
CPC B65H 19/28; B65H 19/283; B65H 2408/235; B65H 2301/41425; B65H 19/2269
See application file for complete search history.

(56) References Cited

U.S. PATENT DOCUMENTS 6,098,916 A * 8/2000 Matteucci ..... B65H 19/2269 242/527.3
2004/0256513 A1* 12/2004 Perini ..... B65H 19/283 242/521
2008/0283656 A1* 11/2008 Gelli ..... B65H 19/2269 242/521

(Continued)

FOREIGN PATENT DOCUMENTS

| | | |
|---|---|---|
| EP | 2 202 187 | 6/2010 |
| WO | 2006/064151 | 6/2006 |
| WO | 2011/117827 | 9/2011 |

OTHER PUBLICATIONS

International Search Report dated Jan. 23, 2014, corresponding to PCT/IT2013/000190.

*Primary Examiner* — Sang Kim
(74) *Attorney, Agent, or Firm* — Young & Thompson

(57) ABSTRACT

A rewinding machine includes a drawing assembly (1), a winding assembly, a core-change assembly (5), and pneumatic elements for interrupting the continuity of the ply at the end of a winding cycle, and for starting a new winding cycle.

12 Claims, 8 Drawing Sheets

(56) References Cited

U.S. PATENT DOCUMENTS

| | | | |
|---|---|---|---|
| 2009/0302146 | A1 | 12/2009 | Morelli et al. |
| 2010/0163666 | A1 | 7/2010 | Gambini |
| 2012/0153068 | A1 | 6/2012 | Perini |

* cited by examiner

Detail C

Section C-C

REWINDING MACHINE

TECHNICAL SECTOR OF THE INVENTION

The invention relates to a rewinding machine of the type used in the converting sector for unwinding plies of tissue paper from a source reel and winding them on logs for subsequent processes for the production of rolls of paper for domestic use.

PRIOR ART

It is known that there exist on the market many types of rewinding machines, mostly based upon nipping devices that during winding of the paper, when winding of a new log has been completed, exert a brake on the film causing tearing thereof and enabling unloading of the wound log and loading of a new core on which paper is to be wound.

These apparatuses are mostly complex, involve a mechanical intervention on the rotating rollers, and tend to ruin the outer ply of the paper on the wound log, with consequent deterioration of the commercial value of the finished product.

Also known are systems that operate by difference of velocity between the roller assembly that draws the paper off the reel and the assembly for winding the paper on the log being formed. If this turns with a peripheral velocity higher than the former, the paper will tend to tear, thus enabling a new working cycle.

A machine of the above type is known from the patent application No. FI2009A000125 filed in the name of the present applicant.

Systems based upon the difference of velocity solve the problems described above of nipping systems, but in turn are not always sufficiently reliable in terms of certainty of the instant and of the point at which tearing must take place.

OBJECT OF THE INVENTION

The object of the present invention is to provide a re-reeling machine that will be free from the drawbacks of the prior art and that will enable execution of tearing of the ply in a reliable way even at high speeds of winding of the ply.

A further object is to obtain a finished product that will be free from defects due to mechanical interventions.

A further object is to obtain an automatic machine with a high degree of flexibility in programming the instant of tearing of the paper and synchronization with the mechanism of advance thereof.

SUMMARY OF THE INVENTION

The above purposes have been achieved by providing a re-reeling machine according to at least one of the annexed claims.

A first advantage lies in the fact that the cycle of winding of the log can proceed at high speeds of the paper, maintaining the quality of the finished product and the accuracy of tearing of the paper at the instant of log change.

LIST OF THE DRAWINGS

The above and further advantages will be better understood by any person skilled in the branch from the ensuing description and the annexed drawings, which are provided by way of non-limiting example and in which.

DETAILED DESCRIPTION

Figure 1:
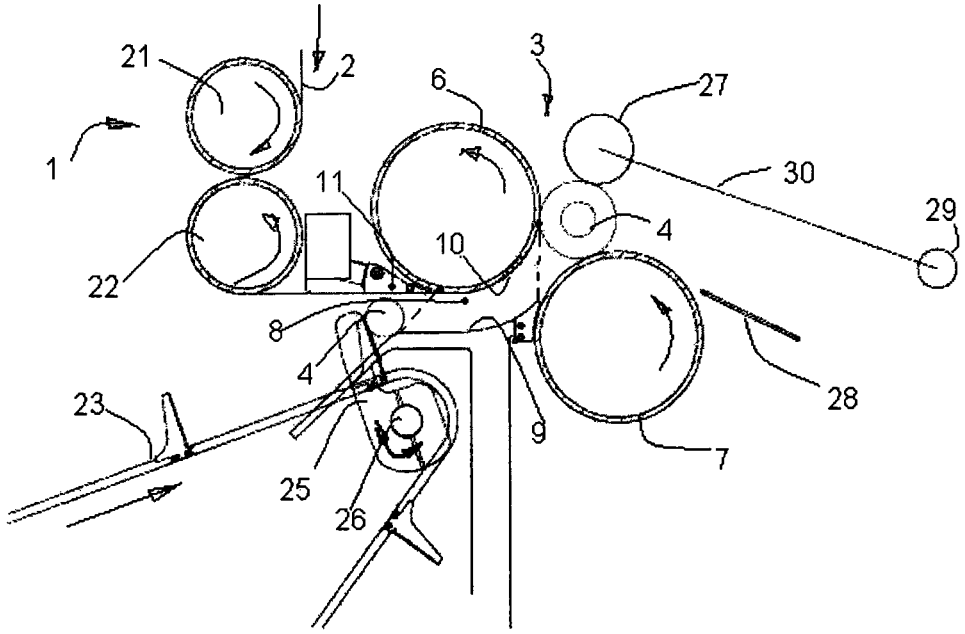
FIGS. 1-6 are schematic illustrations of a machine according to the invention in successive operating steps.
Figure 2:
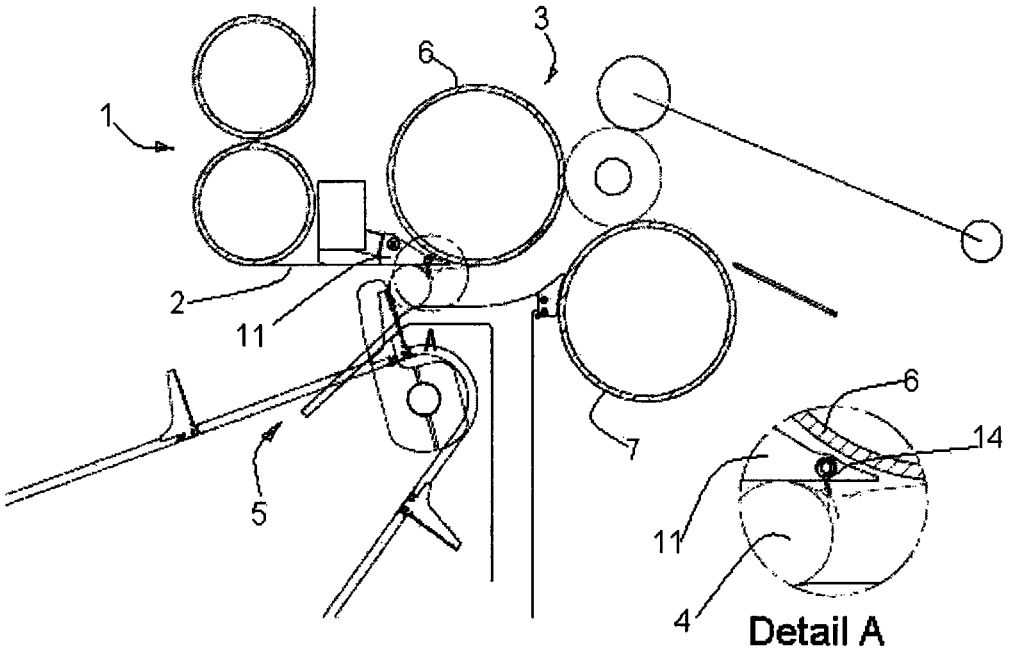
Figure 3:
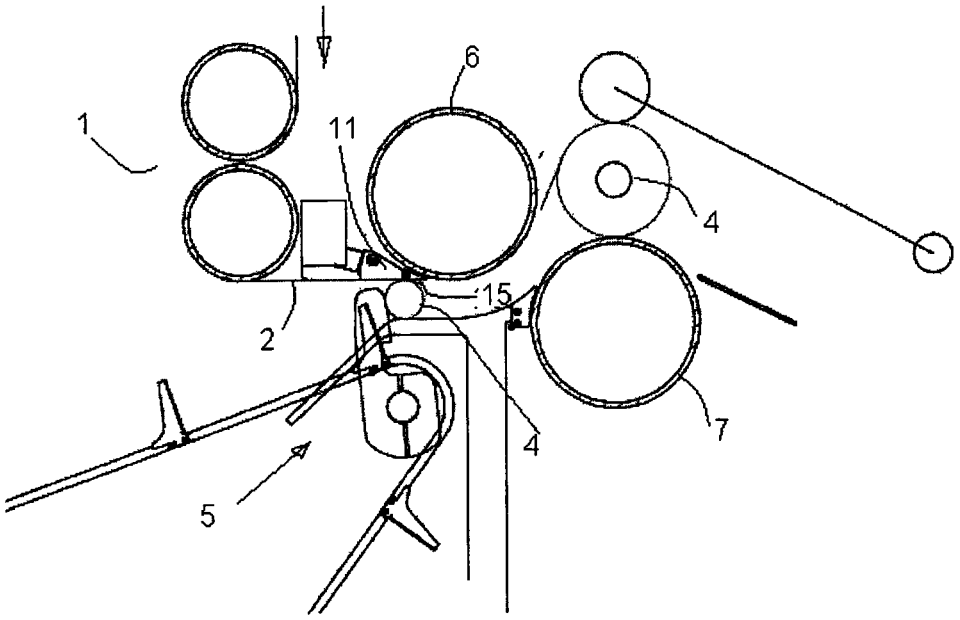
Figure 4:
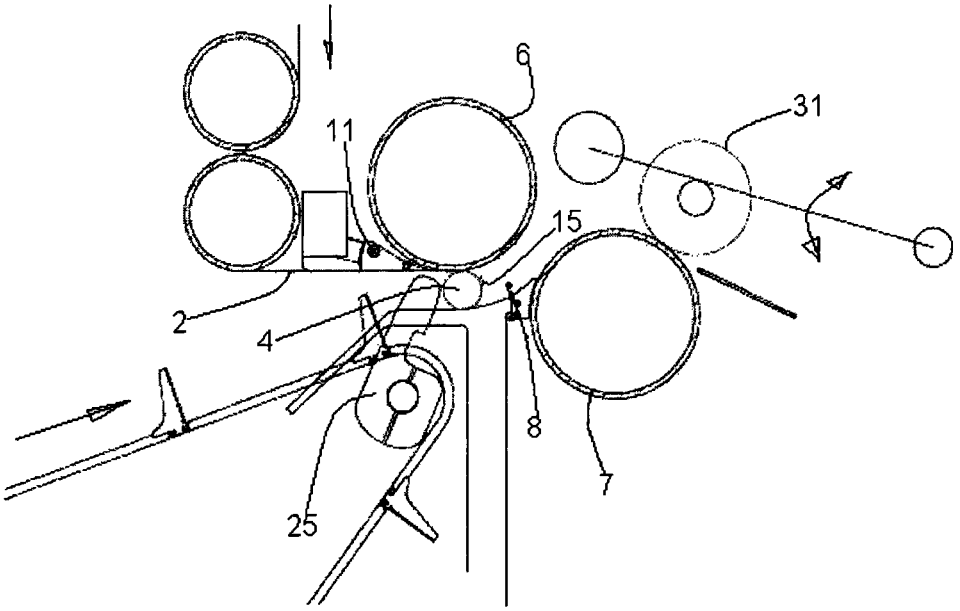
Figure 5:
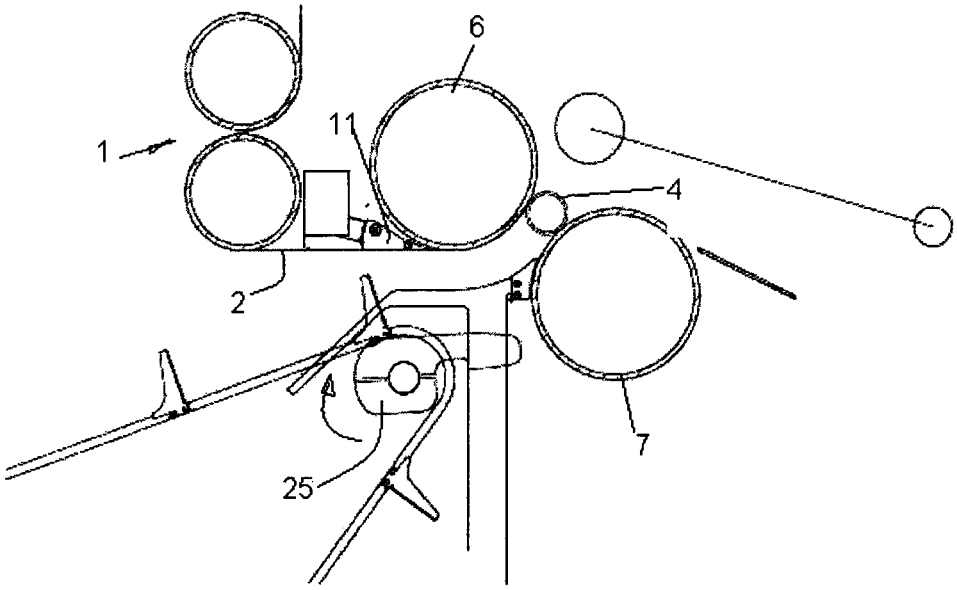
Figure 6:
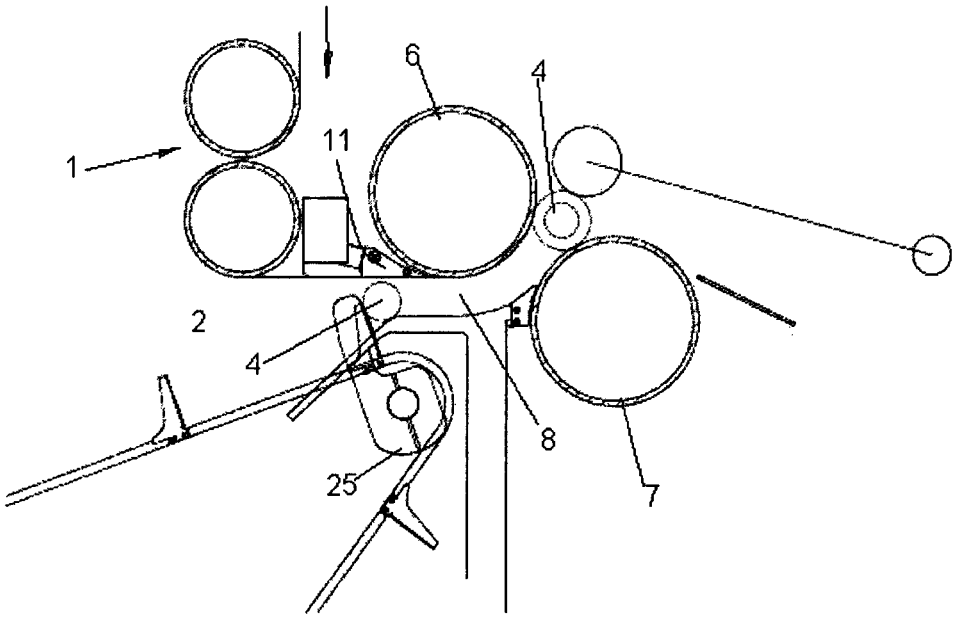
Figure 8:
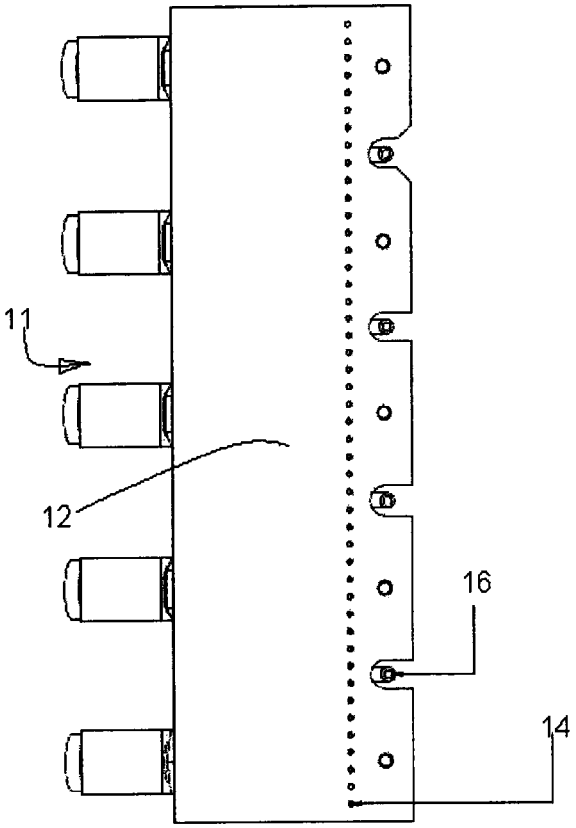
FIGS. 7 and 8 represent, respectively, a lateral see-through view and a view from beneath of an air dispenser for a rewinding machine according to the invention.
Figure 7:
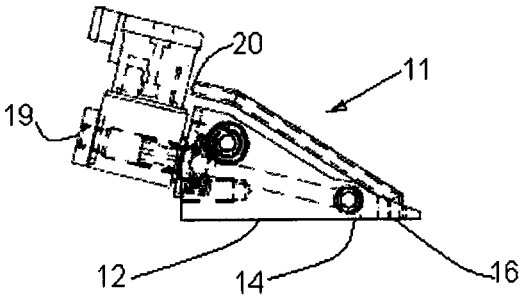
Figure 9:
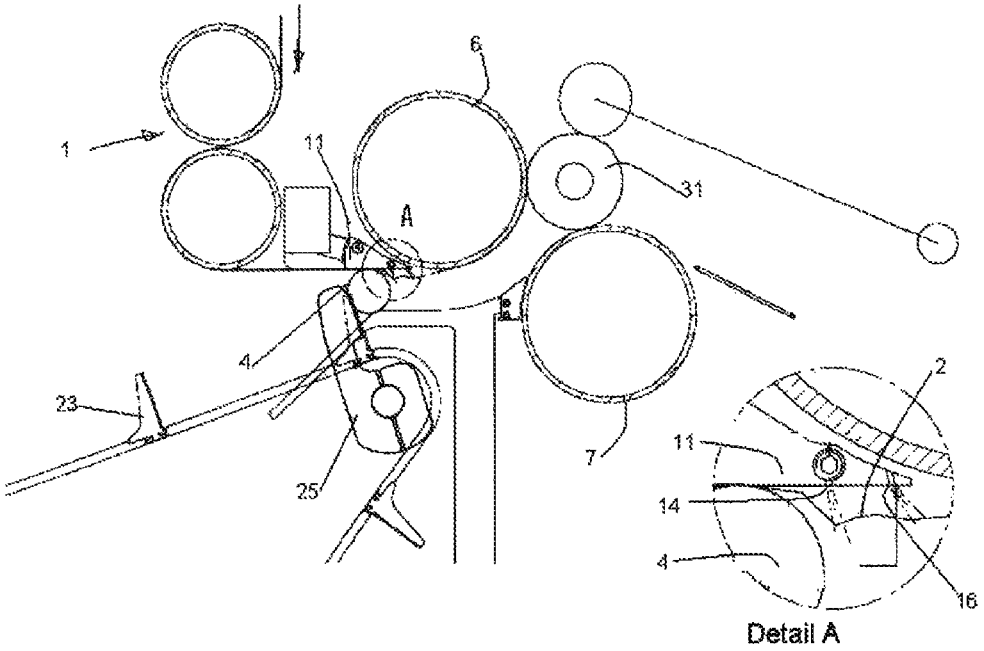
FIG. 9-13 are schematic illustrations of a second embodiment of a machine according to the invention in successive operating steps.

With reference to the annexed drawings, a rewinding machine is described, comprising a drawing assembly 1 for feeding a ply 2 wound off a main reel set upstream of the assembly 1 and not illustrated.

The drawing assembly comprises a first roller 21 and a second roller 22, which are counter-rotating in contact with one another, between which the ply 2 is drawn.

Downstream of the drawing assembly, in the direction of advance of the ply 2, a motor-driven winding assembly 3 is provided for winding the ply fed by the drawing assembly around a tubular core 4 on which paper is to be wound to form a reel of paper, or log, of the desired dimensions.

The assembly 3 comprises a primary roller 6 and a secondary roller 7 rotating in contact with the core 4 on which paper is being wound, and a pressure roller 27, which rotates in contact with the log being formed and can move in recession from the rollers 6, 7, for example being carried by arms 30, represented schematically in the figures, rotating about an axis 29.

The assembly 3 further comprises a channel for passage 8 delimited by a bottom chute or cradle 9 and by the sector 10 of the surface of the primary roller 6, which, during winding, is in contact with the core 4.

In operation, the core 4 is introduced into the channel 8 by a lift 23, which brings the core 4 into the proximity of the channel 8, and by a pusher 25, for example of the crank type rotating around a pin 26 belonging to a core-change assembly 5, provided for carrying out expulsion from the machine of a finished log at the end of a winding cycle and insertion of a new core on which paper is to be wound.

In order to be able to carry out core change, i.e., replacement in the machine of a finished log with a new core on which paper is to be wound, means are provided for interrupting the continuity of the ply at the end of a winding cycle, and for winding a flap 15 for drawing the ply 2 onto the new core 4 at the start of a new winding cycle.

According to the invention, the interruption means operate upstream of introduction of the new core 4 into the channel 8 and comprise a dispenser of pressurized air 11 capable of sending onto the ply a jet of pressurized air sufficiently high as to cause tearing of the ply, possibly in the presence of weakening perforations in the ply itself. Indicatively, a pressure range suited to the purpose is from 5 to 10 bar.

Preferably, the dispenser 11 is constituted by a wedge-like body 35, extending in width throughout the width of the ply 2 and facing the channel 8 so that it can be inserted between primary winding roller 6 and the core 4.

The dispenser further comprises a distribution of nozzles 14, which communicate with a source of air 19 at high pressure and oriented for sending a jet of air onto the ply 2 and causing tearing thereof.

Advantageously, the distribution of the nozzles 14 and the distance between the nozzles and the ply are such as to create a continuous blade of pressurized air that impinges upon the paper and causes uniform tearing throughout the width of the ply.

Indicatively, the nozzles 14 may be set apart from one another by approximately 5-10 mm and in use be in the immediate vicinity of the ply 2.

With reference to FIGS. 14-17, a preferred conformation of the dispenser 11 is illustrated.

In this embodiment, the body 35 is provided with seats 36, for example six seats, for housing respective air valves 37 capable of releasing simultaneously a flow of air towards outlet ducts 38 which converge into a first transverse manifold 39, which has the function of creating a single compensation chamber for rendering the pressure of the flow uniform.

Exiting from the manifold 39 are further ducts 40, preferably grouped in series, for example eight manifolds, converging in respective chambers 41, having a semi-cylindrical shape.

The chambers 41 are in turn closed by a contrast surface 42 of an end portion 43, which can be tightened, for example by means of screws 46, against a corresponding contrast surface 44 of the body 35.

Advantageously, the contrast surfaces 42 and 44 are shaped so as to create nozzles in the form of slits 47, which communicate with the chambers 41 and are oriented for sending a laminar jet of air towards the ply 2, causing tearing thereof.

In order to facilitate tearing of the ply, the machine may moreover comprise means for nipping the ply upstream of the channel 8 that withhold the ply at the instant of sending the jet or blade of air onto the ply.

In the embodiment described, the nipping means comprise the bottom surface 12 of the dispenser 11, which is set in such a way as to remain substantially aligned with the tangent of the primary roller 6 in the point of insertion of the core 4, and which acts in contrast with the ply 2 in combination with the outer surface of the new core 4 drawn by the pusher 25 at inlet to the channel 8.

Once tearing has occurred, the continuity of the ply 2 is interrupted, and the log that has been formed is expelled via a chute 28 whilst the flap 15 for drawing the ply fed by the drawing assembly 1 must be wound around the new core 4 to start a new winding cycle.

For this purpose, means are provided for winding the flap for drawing the ply, which may comprise a distribution of glue 50 over the surface of the new core on which paper is to be wound.

In this case, drawing of the flap of ply is obtained as a result of the contact between the surface of the core 4 and the flap 15 itself.

Figure 10:
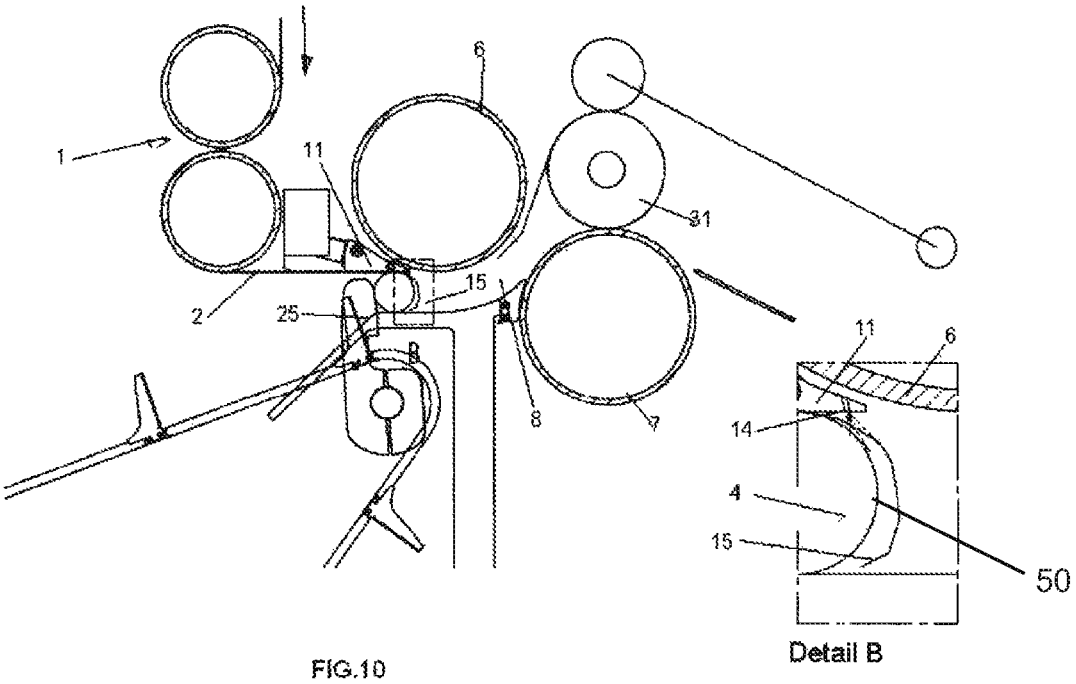
Figure 11:
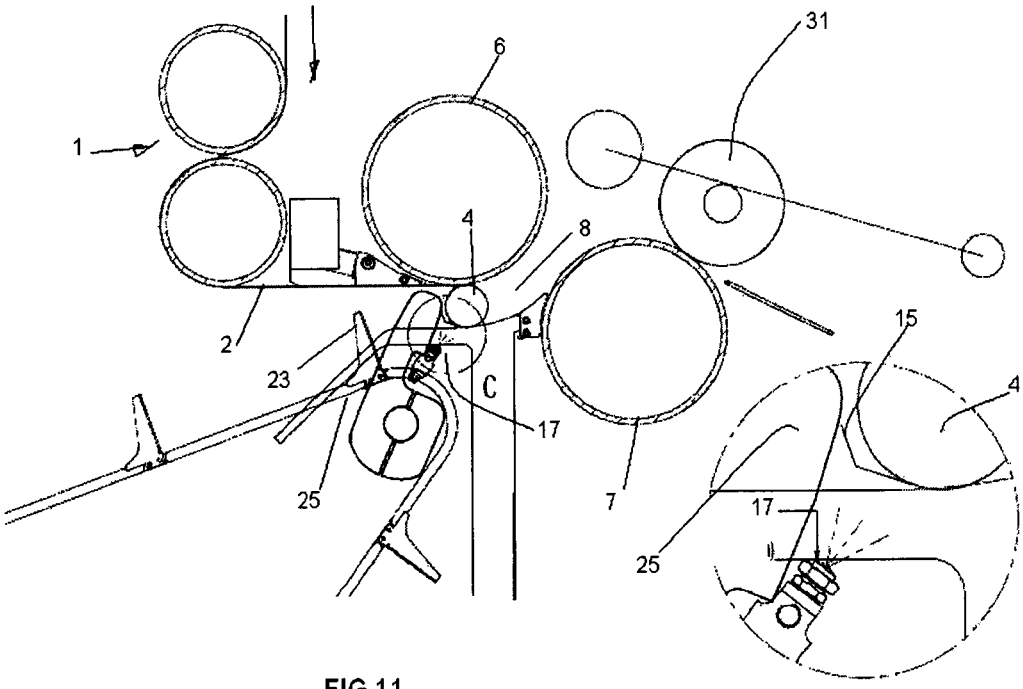
Figure 12:
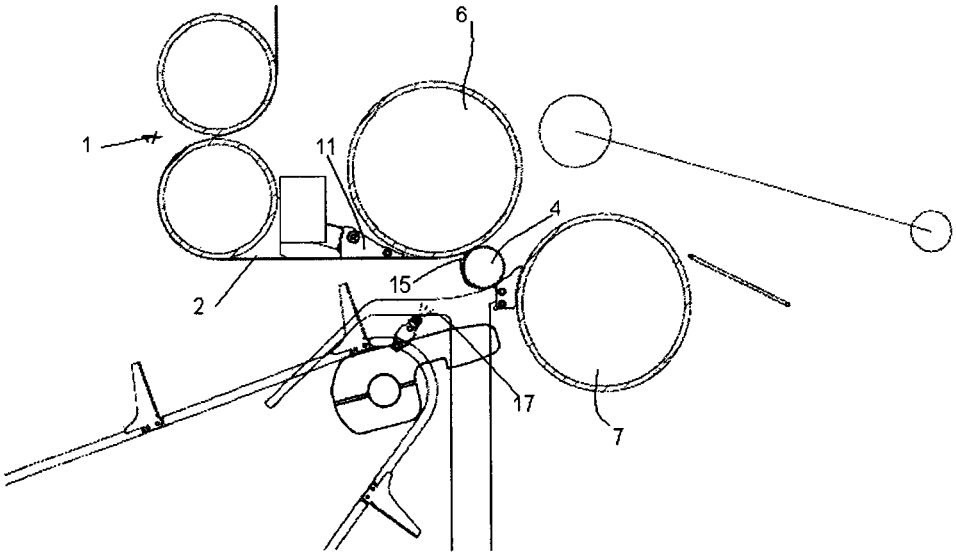

According to the invention, and with particular reference to FIGS. 9-13, the dispenser 11 is provided with a distribution of further nozzles 16, which communicate with a source of air at low pressure 20 and are oriented for sending a jet of air towards the flap for drawing the ply 2 and starting a first turn of winding of the ply on the surface of the core 4 (FIG. 10).

Figure 13:
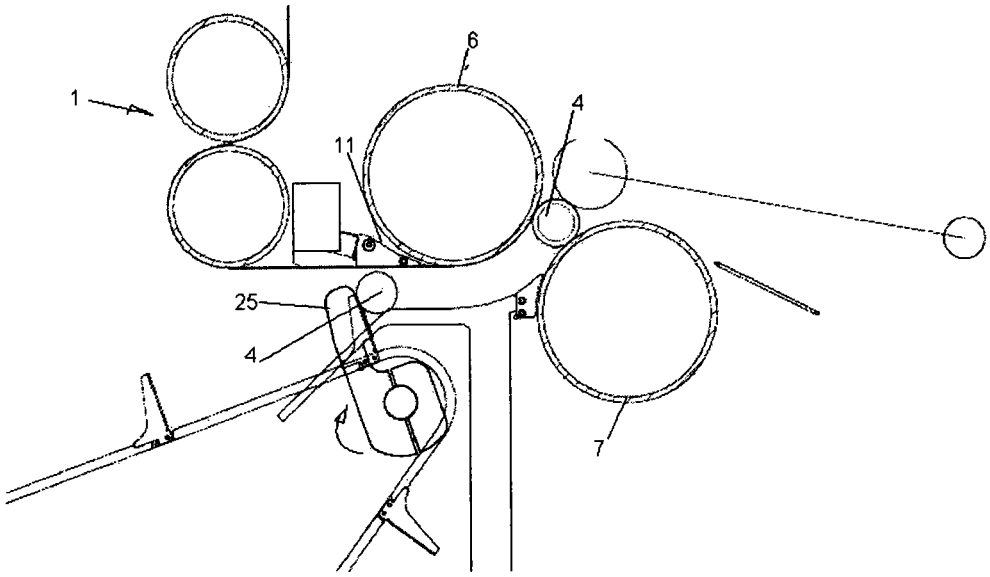
Figure 14:
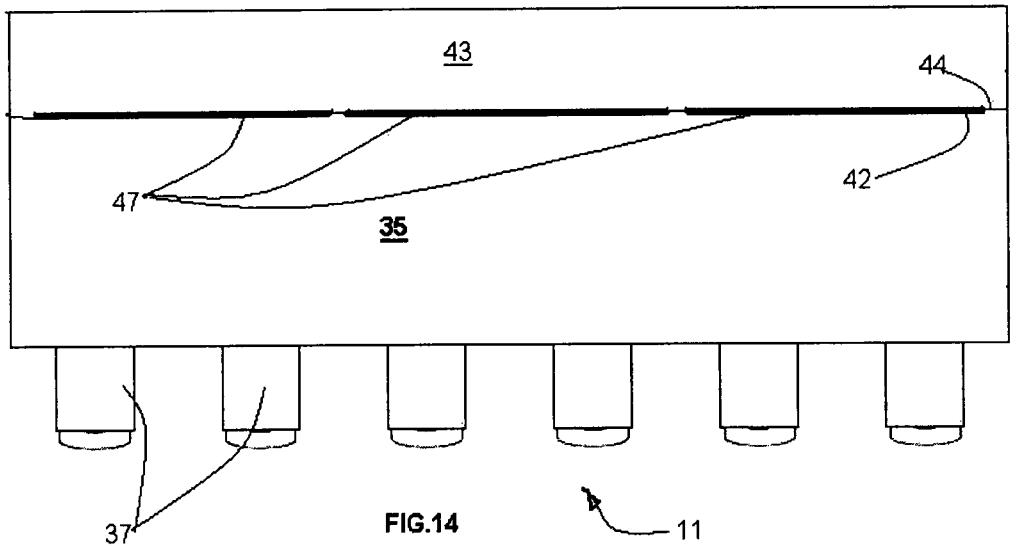
FIGS. 14-17 illustrate a preferred conformation of the dispenser according to the invention.
Figure 15:
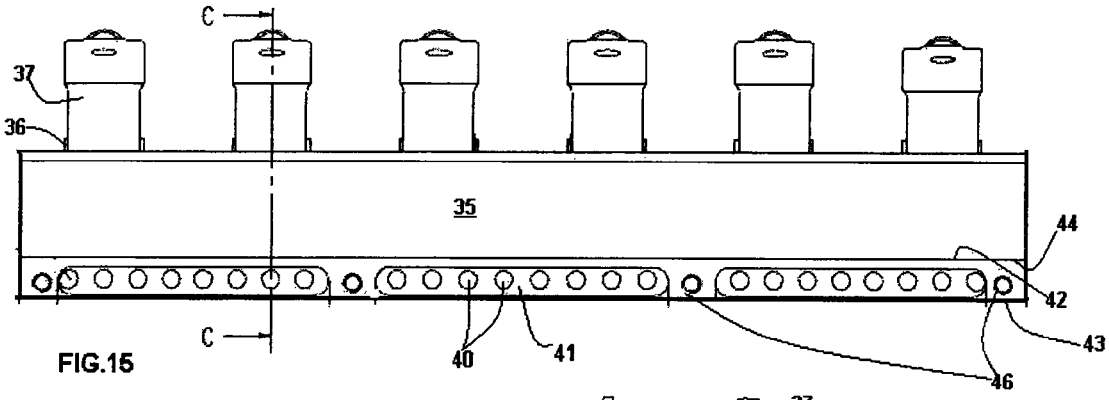
Figure 16:
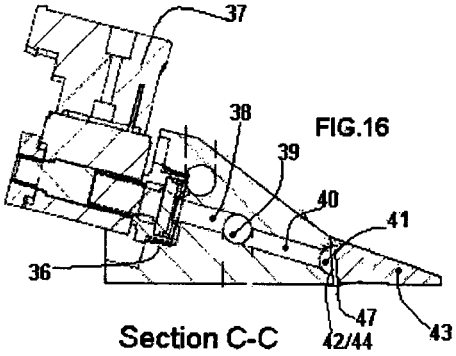
Figure 17:
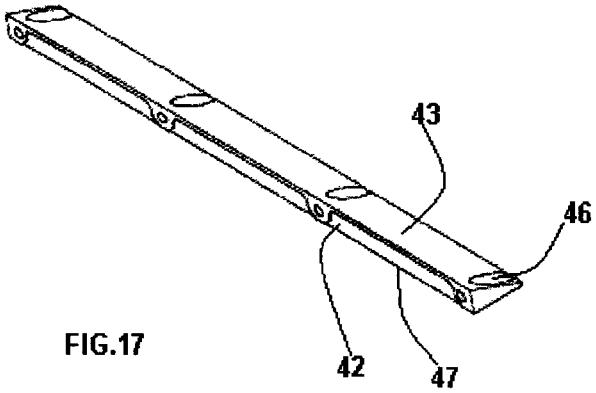

To facilitate completion of the first winding, the machine may moreover comprise further nozzles 17 arranged underneath the channel 8 for sending a jet of air at low pressure from beneath onto the flap 15 and completing the first turn of winding of the ply on the surface of the core (FIGS. 11-12), which in the path along the channel 8 turns and draws along with it the free flap that remains withheld between the core and the overlying stretch of ply. When the core 4 is in contact with the winding rollers 6, 7, the winding cycle proceeds, and a new core 4 is brought up against the channel 8 awaiting end of the cycle in progress (FIG. 13).

The invention achieves important advantages because it enables execution of the step of interruption of the ply in a uniform way that is synchronised with the winding cycles, which can thus be brought to higher speeds as compared to known solutions.

For this purpose, the machine envisages that the motor drives of the drawing, core-change, and winding assemblies and the control of the pneumatic components are managed by an electronics that presides over synchronization of the speed of rotation and issuing of the blade of air for interruption of the ply and start of the winding cycle.

The present invention has been described according to preferred embodiments, but equivalent variants may be devised, without thereby departing from the sphere of protection granted.

The invention claimed is:

1. A rewinding machine comprising:

a drawing assembly for feeding a ply;

a winding assembly for winding the ply fed by the drawing assembly around a core on which the ply is to be wound, comprising a primary roller and a secondary roller rotating in contact with the core on which the ply is being wound, and a channel for passage of the core delimited by a bottom chute and by a sector of the surface of the primary roller that, during winding, is in contact with the core;

a core-change assembly for expelling from the machine through said chute a core at the end of a winding cycle and inserting a new core on which the ply is to be wound;

a tearing device configured to interrupt the continuity of the ply at the end of a winding cycle; and a winder configured for winding a flap for drawing the ply onto the new core at start of a new winding cycle, wherein said tearing device is operative upstream of introduction of the new core into said channel and comprise a dispenser of pressurized air for sending a jet of pressurized air onto the ply.

2. The machine according to claim 1, wherein said tearing device further comprises a nip for nipping the ply upstream of the channel.

3. The machine according to claim 2, wherein said nip comprises a contrast surface of the dispenser operating in combination with the outer surface of the new core entering the channel.

4. The machine according to claim 2, wherein said winder comprises a distribution of glue on the surface of the new core on which the ply is to be wound.

5. The machine according to claim 2, wherein said dispenser comprises a distribution of first nozzles arranged crosswise with respect to the direction of advance of the ply, which communicate with a source of pressurized air oriented for sending a jet of air onto the ply.

6. The machine according to claim 1, wherein said winder comprises a distribution of glue on the surface of the new core on which the ply is to be wound.

7. The machine according to claim 1, wherein said dispenser comprises a distribution of first nozzles arranged crosswise with respect to the direction of advance of the ply, which communicate with a source of pressurized air oriented for sending a jet of air onto the ply.

8. The machine according to claim 7, wherein said dispenser comprises means for rendering the jet of air uniform in the transverse direction of the ply.

9. The machine according to claim 8, wherein said winder comprises a distribution of second nozzles of the dispenser which communicate with a source of pressurized air and are oriented for sending a jet of air onto the flap.

10. The machine according to claim 1, wherein said winder comprises pneumatic means arranged upstream of the channel for sending a jet of pressurized air onto said flap for drawing and starting a first turn of winding of the ply on the surface of the core.

11. The machine according to claim 1, wherein said winder further comprises nozzles for sending a jet of pressurized air onto the flap and completing the first turn of winding of the ply on the surface of the core.

12. A dispenser of pressurized air for rewinding machines for winding a ply according to claim 1, comprising a main body substantially extending throughout the width of the ply and provided with a distribution at least of first nozzles, which communicate with a source of pressurized air for sending onto the ply a jet of pressurized air that is able to cause transverse tearing of the ply.

* * * * *